United States Patent [19]

Eigenmann

[11] 4,369,001

[45] Jan. 18, 1983

[54] METHOD FOR FORMING HIGHLY RETRO-REFLECTING ROADWAY SURFACE MARKING

[76] Inventor: Ludwig Eigenmann, POB 8, CH 6833 Vacallo, Switzerland

[21] Appl. No.: 260,289

[22] Filed: May 4, 1981

Related U.S. Application Data

[63] Continuation of Ser. No. 54,145, Jul. 2, 1979.

[30] Foreign Application Priority Data

Jul. 7, 1978 [IT] Italy ..... 25462 A/78

[51] Int. Cl.[3] ..... E01C 23/16

[52] U.S. Cl. ..... 404/94

[58] Field of Search ..... 404/93, 94, 72

[56] References Cited

U.S. PATENT DOCUMENTS

| | | | |
|---|---|---|---|
| 3,086,431 | 4/1963 | Perry | 404/94 |
| 3,590,701 | 7/1971 | Broeck | 404/94 |
| 3,864,052 | 2/1975 | Blomberg | 404/94 |
| 3,886,011 | 5/1975 | Eigenmann | 404/94 X |
| 4,136,991 | 1/1979 | Clark | 404/94 X |
| 4,279,534 | 7/1981 | Eigenmann | 404/94 X |
| 4,322,177 | 3/1982 | Eigenmann | 404/93 X |

*Primary Examiner*—Nile C. Byers, Jr.
*Attorney, Agent, or Firm*—Michael J. Striker

[57] ABSTRACT

Method for forming a retro reflective traffic regulating road surface marking and roadable areas produced therewith.

8 Claims, 9 Drawing Figures

Fig. 1
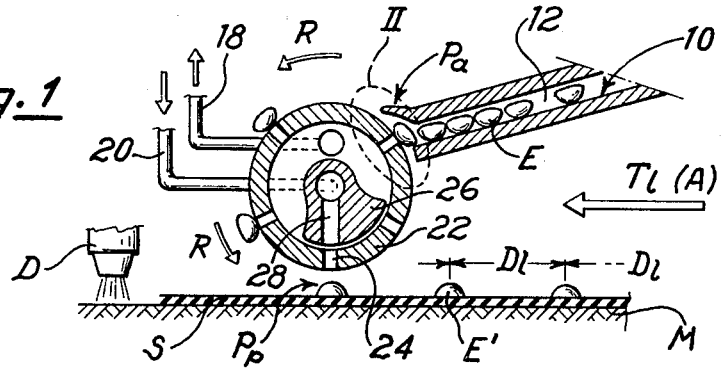
Fig. 2
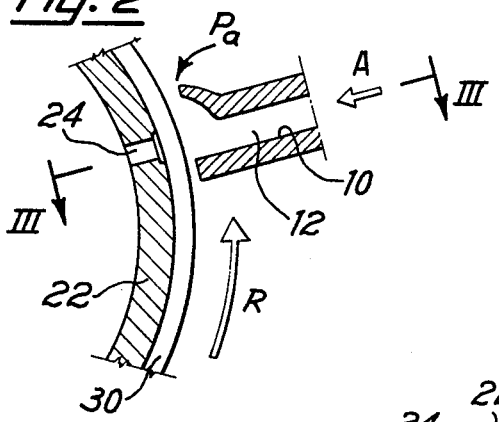
Fig. 2 A
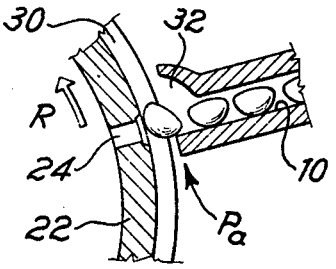
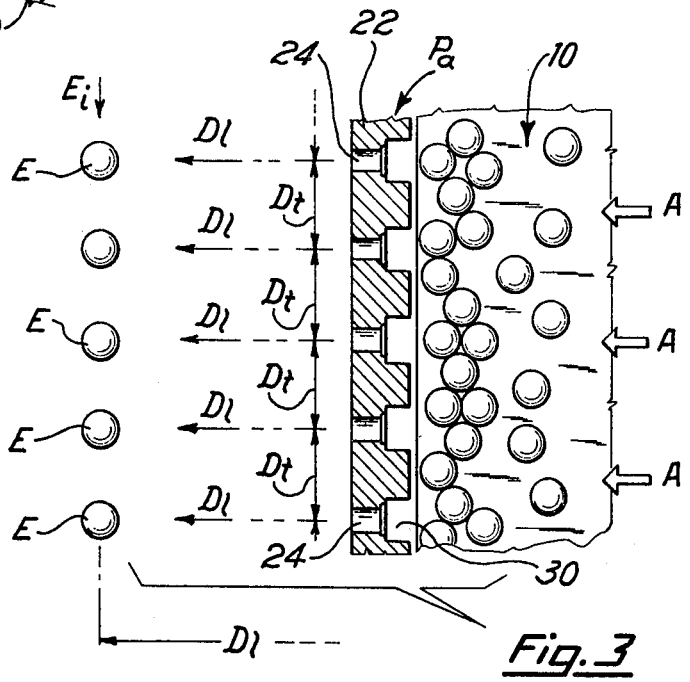
Fig. 3

METHOD FOR FORMING HIGHLY RETRO-REFLECTING ROADWAY SURFACE MARKING

This is a continuation of application Ser. No. 54,145, filed July 2, 1979.

BACKGROUND OF THE INVENTION a. The Field of the Invention

This invention is concerned in general with the formation of traffic regulating markings on roadway pavements or other roadable surfaces such as traffic lane dividing and/or lane edge forming lines the direction of which generally corresponds with that of usual movement of the vehicle along the road.

More particularly the present invention is concerned with forming of traffic regulating marking including in the marking defining surface area retro reflecting elements adapted to provide retro reflection of the light beams irradiated by the vehicles headlamps in night time and/or the visibility is prejudiced by the weather.

Said retro reflecting elements concerned with the invention are secured to the road pavement by means of a carrying layer which can be formed of a paint, a resinous layer of a prefabricated tape material adapted to be laid on and adhesively secured to the road pavement generally by means of an intermediate primer layer. The layers to which the retro reflecting elements are secured to the road pavement are known in the art and do not individually form characteristics of the invention, and provided that the retro reflecting elements are properly positioned and firmly secured to the road pavement, the road pavement, the layer with which said elements are associated will be encompassed within the definition "carrying or anchoring layer" herein below.

b. The Prior Art

The art of forming traffic regulating signs including retro reflecting generally globular elements is known and worked one, and extensive comments thereabout are unnecessary. The arrangement and the principles of such retro reflecting elements have been disclosed for example in the U.S. Pat. Nos. 3,964,821 and 4,049,337 granted to the instant applicant. A particularly advantageous retro reflective element has been disclosed in another applicant's U.S. Pat. No. 4,072,403.

Generally speaking, the visibility at distance of the retro reflective elements in service, on a given surface area, and assuming that the elements consistently protrude above the surface of the actual carrying layer, is proportional to the density of same elements, that is to the number of elements circumscribed within a definite area. The brilliancy of the marking, in response to light beams irradiated by a vehicle headlamp, is grossly proportional to the density of elements.

On the other hand element density must not go over or under certain limits, even disregarding the cost, taking principally into account the following consideration:

(a) as discussed in the above referred U.S. Pat. Nos. 3,964,821 and 4,049,337 such elements are impinged by grazing light, that is by rays forming a small angle to the road pavement;

(b) the elements protrude above the surface of the marking for a noticeable height, such as from 1 mm to 6 mm, preferably of 2 or 3 mm approx. Therefore, when impinged by grazing light, each element forms a shadow which covers a part of the marked area;

(c) when the shadow covers part of the following element, this element is proportionally disactivated; when the shadow leaves too much uncovered area the brilliancy is proportionally damaged;

(d) the marking forms itself a part of the roadable surface which must be non-skidding and therefore the element density must be such as to not provide a skiddish surface; this latter feature is important in the direction of travel, which corresponds to light impingement. Safe adherence is essential during accelerations, emergency brakings and the like. Therefore the elements must be so spaced to provide good adherence in the interspaces in the direction of travel.

In the U.S. Pat. No. 4,069,281 (in particular FIGS. 6 and 11) the applicant has proposed specifically to arrange for marking tapes in resin protrusion and reflective elements in rows perpendicular to the lane marking, that means perpendicular to the grazing light impingement. It was not clear at the time the importance for the maximum brilliancy to have all the reflective elements exactly positioned and aligned in rows, that means to have these elements prealigned because applying the same to the marking material and the rows exactly spaced one from the other.

OBJECTS AND BRIEF SUMMARY OF THE INVENTION

It is an essential object of the invention to provide a method which provides the very high brilliancy or optical response, resulting from a prealignment of the elements and from the application of the resulting rows perpendicular to the grazing light direction to the marking material, securing the best optical results, to the longitudinal grazing light impingement shadows greater areas compared to the uncovered areas in front of the following elements.

According to the invention the elements comprise retro reflective elements of at least 0.8 mm height above the marking surface and the greatest spacing in the direction perpendicular to impingement is no more than 4 element diamter, this spacing depending from the conditions necessary for traffic safety.

More particularly the method for forming the roadway surface marking comprises the steps of spraying a traffic wear resistant marking layer; of supplying and progressing a flow of retro reflecting elements on a carrying surface.

The elements, resin made retroreflecting elements are of the essentially asymmetrical type (for example described in the U.S. Pat. No. 4,072,403); symmetrical elements can as well be made use of.

The resinous elements in service on the road are subject to mechanical wearing; but the same traffic provides a somewhat polishing of the plastic element surface. It is essential to provide a suitable element arrangement to ensure not only an optimum brilliancy but also the right positioning so that when the wearing occurs the adjacent elements optically interreact so that the total brilliancy curve will very slowly decrease.

It has been found that a proper lateral spacing located in rows in a quincunx arrangement for example, satisfies the requirement. A lateral spacing of more than 5 diam. is very disadvantageous. A lateral spacing of 1 diam. is advisable. A longitudinal spacing of more than 12 diam. is disadvantageous, a longitudinal spacing of 6 diam is advisable.

These and other important objects and features of the invention will be now made apparent from the following detailed description of preferred embodiments of same invention, taken together with the accompanying drawings, wherein:

THE VIEWS OF THE DRAWINGS

FIG. 1 is a longitudinal vertical cross sectional view of a device adapted for spacingly and alignedely laying under pressure suitably orinted reflective elements carrying layer, such as paint, preliminary formed on a roadway pavement;

FIG. 2 illustrates in greater scale and detail the part contained in the contour indicated at II FIG. 1;

Figure 4B:
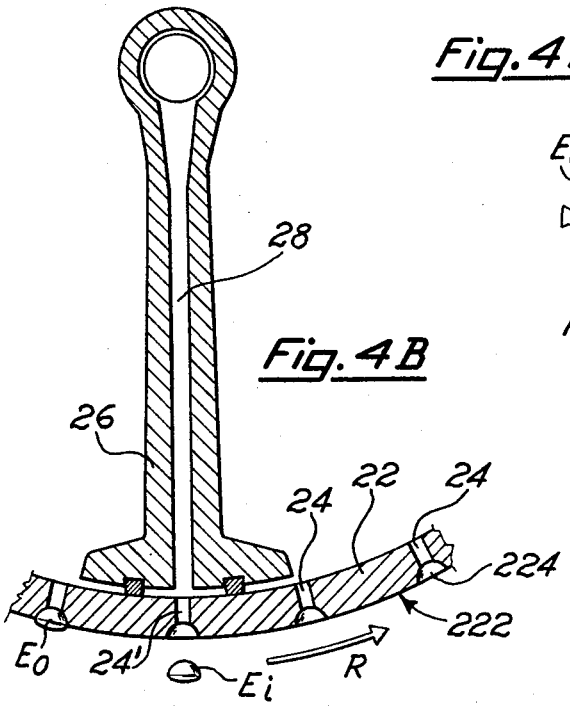
Figure 4A:
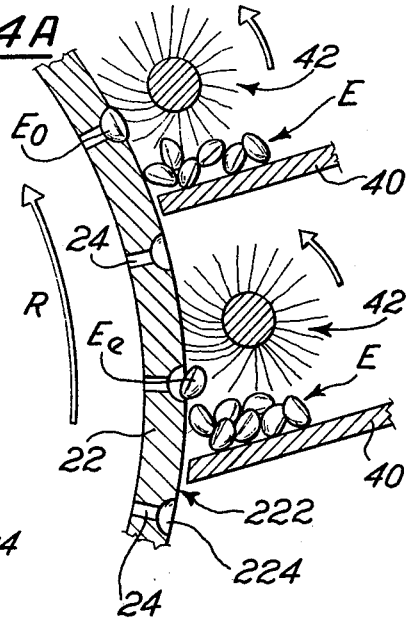
Figure 5A:
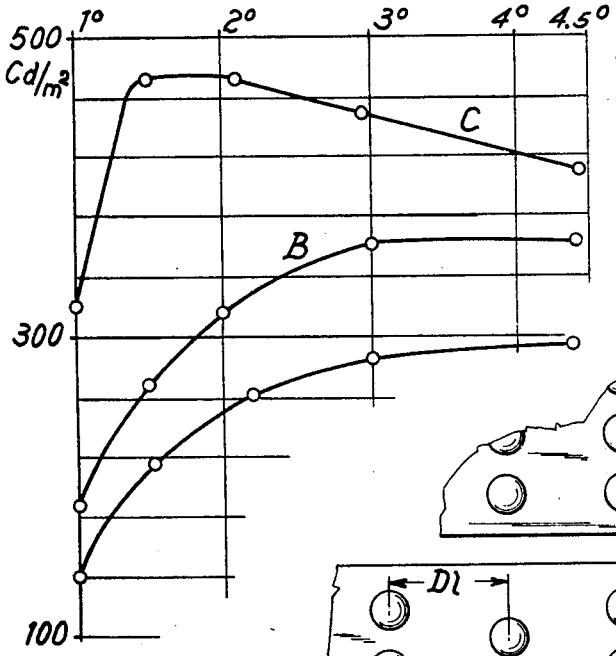
Figure 5B:
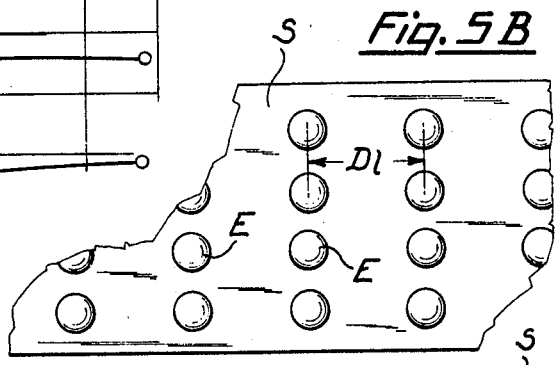
Figure 5C:
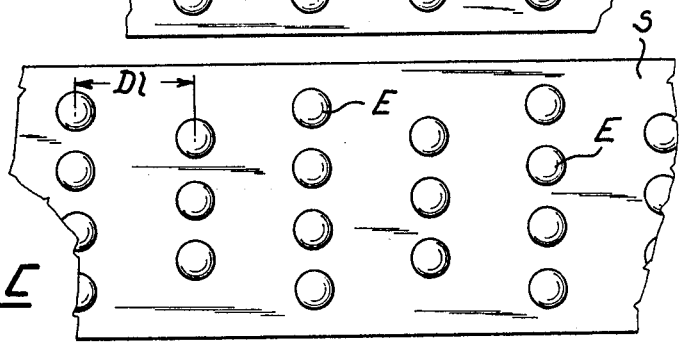

FIG. 2A fragmentarily illustrates the detail of FIG. 2;

FIG. 3 illustrates in a somewhat inverted arrangement of parts, the results of the device of FIGS. 1 and 2 taken in the plane and in the direction indicated at III—III in FIG. 2;

FIGS. 4A, 4B illustrate in vertical sectional view and in somewhat greater detail, a preferred modification of the device; and FIGS. 5A, 5B and 5C are a graph and correlated diagrams.

DETAILED DESCRIPTION OF THE PREFERRED EMBODIMENTS

FIGS. 1 and 2 diagrammatically illustrate a preferred embodiment of an element aligning and element rows laying down device. The not critically inclined plane 10, which can be replaced by another arrangement for progressing retro-reflecting elements, has its outlet portion 12 facing the outer surface of a hollow cylinder 22 provided with rows of holes 24. A stationary component 26, supported within the cylinder 22, has a row of ducts 28 indexed with the holes 24 where downturned and facing the carrying surface layer S, said ducts 28 being connected to a source of pressurized air (not shown). The remaining parts of the inside of cylinder 22 are connected to a source of vacuum. Therefore a suction is applied to all holes except to holes 24', which are ejecting a flow of air.

The outlet Pa (FIG. 2) of the portion of the passage along which the elements progress is shaped to facilitate the orientation of the elements into grooves 30 (FIG. 3) which define the transversal distance Dt of the element E' to be laid down in proper aligned relationship, the longitudinal distance Dl being defined by the speed of longitudinal translation A (FIG. 1) of the device over the carrying and anchoring surface S (such as a freshly layer paint) over the road pavement material M. The device can be mounted on a vehicle adapted to travel on the road, and which concurrently forms the painted road marking.

The preferred embodiment of the device, fragmentarily illustrated in FIGS. 4A and 4B performs also the orientation of the elements E namely asymmetrical elements of the type disclosed in the above indicated U.S. Pat. No. 4,072,403. The elements E are supplied at random over carrying surfaces adjacent to the outer surface 222 of the cylinder 22, the holes 24, to which a suction is applied, as above described (except to the downturned hole 24', FIG. 4B) having recesses 224 mating the dome shape configuration of the elements. When an element E has or acquires a proper orientation, such as the oriented element Eo of FIG. 4A, it engages in the recess 224 and remains retained thereinto by suction and it is carried along with the cylinder 22 which rotates in direction R until the associated hole attains the downwardly turned position Ei; for ejection, upon the pressure applied in the ducts 28, together with any other co-oriented and co-aligned elements Eo.

It is evident that some elements E will not at random fit into a recess 224. The surface 222 of the cylinder is associated by rotary brushes 42 which detaches the erroneously oriented element Ee (FIG. 4A) for recycling into abutment with the surface 222 of the cylinder. A number of carrying surfaces 40 and of brushes 42 are provided about the cylinder 22 and therefore the most of the elements will be caught in their oriented position Eo preparatory to be ejected in rows Ei. The recesses 224 of the holes 24 define the alignment position at which the caught and suction retained elements are aligned in rows Ei preparatory to be ejected under pressure in the position Eo of FIG. 4B on the carrying surface S on a prefabricated road marking tape material or directly on the material of the road pavement on which the device carrying vehicle travels at speed Tl(A) concurrently with a distributor D of the carrying surface S composition (FIG. 1).

The proper spacing and alignment of the elements E on a carrying surface S (such as a painted line on the road pavement) are critical for optical response. FIGS. 5B and 5C illustrate diagrammatical arrangement of elements E in rows perpendicular to the direction of laying down and pressure application of the element on the ground, namely on the carrying and anchoring surface S. The graph of FIG. 5A illustrates the brilliance in conventional candle units as a function of the inclination in degrees of the impinging light, on a marked surface comprising 3330 elements per $m^2$. The brilliancy has been measured at 25 m from the marking surface sample by means of a conventional Pritchard device and the measure has been normalized at value 100 by means of a standardized sample of 99% pure MgO.

The curve C refers to the arrangement of FIG. 5C. The curve B refers to the arrangement of FIG. 5B and the remaining curve refers to the measure of a sample in which an even density of 3330 elements per $m^2$ were arranged at random; for comparison purposes. It is evident that regular arrangement in rows, principally a quincunx such as in FIG. 5C is advantageous, the elements marginally shadowing the adjacent ones also under light impinging at 4°30'.

For optimizing the brilliancy the measure of the intervals Dl between the longitudinally spaced elements is essential. The angle of the impinging light is also essential, because it determines the value of shadowing.

In the following table several density angles of impingement and distances of measurement have been plotted, assuming elements of 45 mm diameter and having one diameter and half lateral interspacing.

| Angle of incidence (degrees) | Seen from (m) | $D_l$ for the arrangement of FIG. 5B (cm) | No. elements × $m^2$ arrangement of FIG. 5B | $D_l$ for the arrangement of FIG. 5C (cm) | No. elements × $m^2$ arrangement of FIG. 5C |
|---|---|---|---|---|---|
| 4.5 | 12.6 | 2.18 | 4563 | 1.09 | 9174 |
| 3 | 19.0 | 3.14 | 3185 | 1.57 | 6370 |
| 2 | 28.9 | 4.61 | 2169 | 2.30 | 4338 |
| 1.5 | 38 | 6.07 | 1643 | 3.03 | 3294 |

-continued

| Angle of incidence (degrees) | Seen from (m) | $D_1$ for the arrangement of FIG. 5B (cm) | No. elements × $m^2$ arrangement of FIG. 5B | $D_1$ for the arrangement of FIG. 5C (cm) | No. elements × $m^2$ arrangement of FIG. 5C |
|---|---|---|---|---|---|
| 1 | 57 | 9.04 | 1106 | 18.08 | 2219 |
| 0.5 | 114.5 | 17.88 | 559 | 35.76 | 1118 |

I claim:

1. A method of forming retro-reflective traffic regulating signs on road surfaces, comprising the steps of spraying a marking layer of traffic wear-resistant and anti-skid material to a road surface in a direction lengthwise to the road surface; aligning retro-reflective elements in rows; and applying said preliminary aligned rows to said marking layer in a direction normal to the elongation of said marking layer and to the light beams emanating from vehicles travelling along the road surface.

2. The method of claim 1, wherein each two successive rows of said retro-reflective elements are spaced from each other at such a distance as to prevent the shadows of one row resulting from impingement of light beams thereon from reaching the next successive row of retro-reflective elements.

3. The method of claim 2, wherein said retro-reflective elements are applied to said marking layer so that they protrude from the road surface not less than 0.9 mm.

4. The method of claim 3, wherein said retro-reflective elements applied to said marking layer are spaced in each row at a distance not greater than 5 element diameters.

5. The method of claim 2, wherein said distance between two successive rows is not greater than 12 element diameters.

6. The method of claim 1, wherein said aligning step includes supplying a progressing flow of said retro-reflective elements to an aligning position, aligning said elements in rows and displacing said rows from said aligning position, and applying said rows towards said marking layer under pressure to thereby facilitate anchoring thereof.

7. The method of claim 6, wherein said marking layer is a traffic paint marking film.

8. The method of claim 6, wherein said marking layer is a multi-layer tape.

* * * * *